US006120068A

United States Patent [19]

DiPietro

[11] Patent Number: 6,120,068

[45] Date of Patent: Sep. 19, 2000

[54] NECKTIE KNOT FORMING APPARATUS AND METHOD

[76] Inventor: Nino DiPietro, 147 Foster Rd., Swampscott, Mass. 01907

[21] Appl. No.: 09/448,741

[22] Filed: Nov. 24, 1999

[51] Int. Cl.[7] ..... B65H 69/04

[52] U.S. Cl. ..... 289/17; 223/111

[58] Field of Search ..... 289/17, 18.1, 1.5, 289/2; 2/144, 148, 149, 152.1; 223/111, 113, 81, 82, 83

[56] References Cited

U.S. PATENT DOCUMENTS 3,752,374 8/1973 Pro ..... 223/111
5,562,456 10/1996 Cianciotto ..... 434/260
5,577,778 11/1996 Parietti et al. ..... 289/17
5,601,318 2/1997 Rusing ..... 289/17
5,864,881 2/1999 Simmons ..... 2/145

*Primary Examiner*—Michael A. Neas
*Attorney, Agent, or Firm*—John P. McGonagle

[57] ABSTRACT

An improved necktie knot forming apparatus and method. The apparatus includes a main, cylindrical body, means connected to the body for holding the necktie in position while the knot is being formed, and two projecting and divergent elongated elements protruding from one end of the cylindrical body, said elements providing wrap assist elements for knot formation.

12 Claims, 9 Drawing Sheets

NECKTIE KNOT FORMING APPARATUS AND METHOD

BACKGROUND OF THE INVENTION

This invention relates to neckties, and in particular to a necktie knot forming device.

Neckties are extensively used and are an important part of a man's dress wardrobe. Neckties are usually manufactured and sold in an untied state, but worn in a knotted configuration. Most men are particular about forming consistent, neat knots in neckties while providing certain desired lengths for one or the other necktie free ends.

One of the most common necktie knots used is the four-in-hand knot. Although the four-in-hand necktie knot is one of the simplest knots used with necktie, it is also one of the most difficult to consistently form. Tying a knot in a necktie, while requiring some minimal skill, is often bothersome and time consuming because the wearer of the necktie has forgotten the correct position and manner of wrapping one free end of a particular tie about the other free end during formation of the knot in the necktie. When the wearer forgets the correct wrapping sequence or degree of wrap used to form a knot in a particular necktie, the repeated trial-and-error attempts at correctly forming the knot is time consuming and often result in wrinkling of the necktie.

A well-known technique for solving the above problems is the use of clip-on ties in which the necktie knot is preformed. Such ties are structurally limited and are not well accepted by most men. Other techniques have been disclosed in the prior art for solving the above problems, however most are quite complicated and often are designed to remain with the necktie while the necktie is being worn. Several prior art devices for forming necktie knots have been disclosed which require insertion of one or both free ends of the necktie into apertures within the device during the knot forming process.

SUMMARY OF THE INVENTION

In view of the foregoing disadvantages inherent in the known types of devices now present in the prior art, the present invention provides an improved necktie knot forming apparatus and method. The apparatus includes a main, cylindrical body, means connected to the body for holding the necktie in position while the knot is being formed, and two projecting and divergent elongated elements protruding from one end of the cylindrical body, said elements providing wrap assist elements for knot formation.

It is, therefore, an object of the present invention to provide an improved necktie forming apparatus that overcomes the limitations of prior art devices and methods.

It is another object of the present invention to provide a necktie knot forming apparatus that is removably attached to the tie during formation of the knot.

It is yet another object of the present invention to provide a small portable knot forming apparatus that is easy to use and operate.

It is a further object of the invention to provide a necktie knot forming apparatus that can be equally utilized by those that have the knowledge and dexterity to form a four-in-hand knot, as we as those that do not.

It is an additional object of the present invention to provide a necktie knot forming apparatus that does not become part of the finished knot and is easily removed after knot formation.

It is still another object of the present invention to provide a necktie knot forming apparatus which is easy to understand and use, as well as requiring a minimum of manual dexterity to form a four-in-hand knot and can be operated utilizing one hand.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF INVENTION

Figure 1:
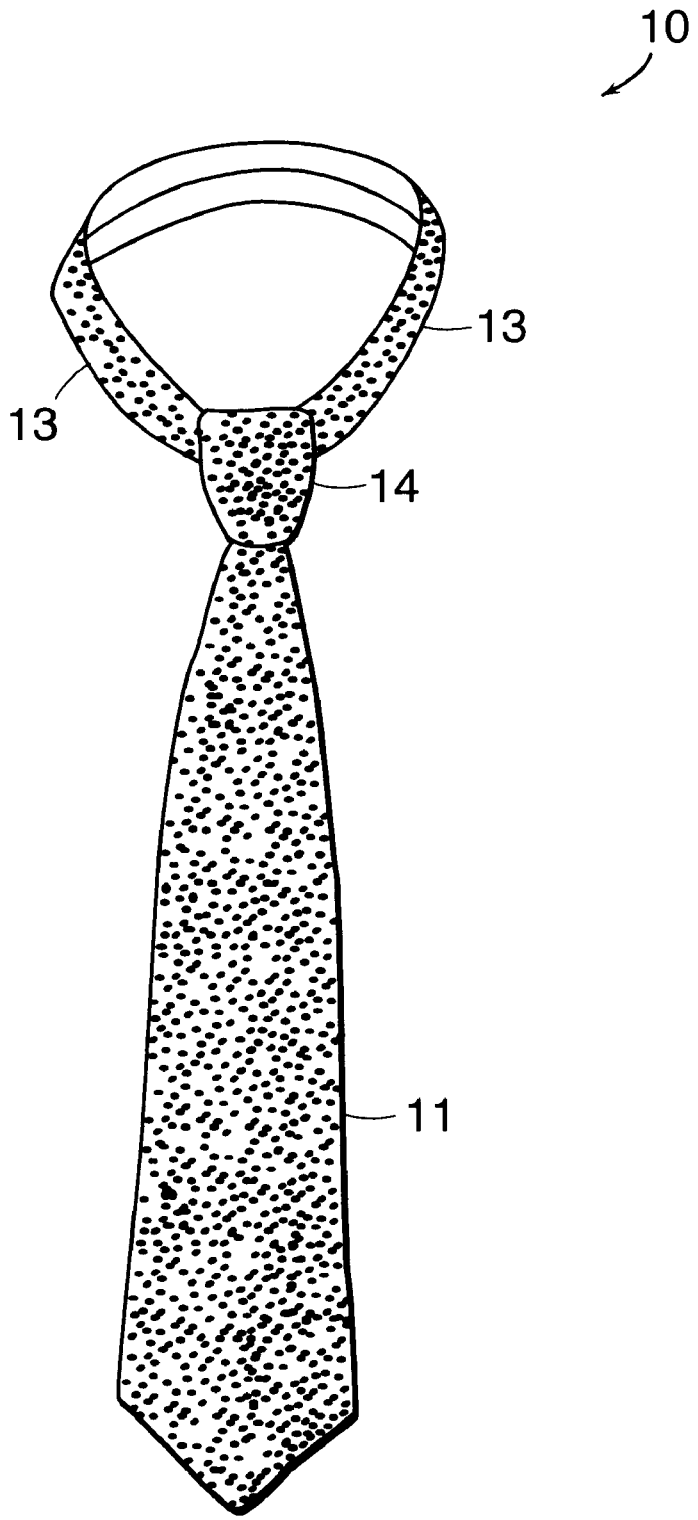
FIG. 1 is a front view of a necktie with a four-in-hand knot formed therein.
Figure 2:
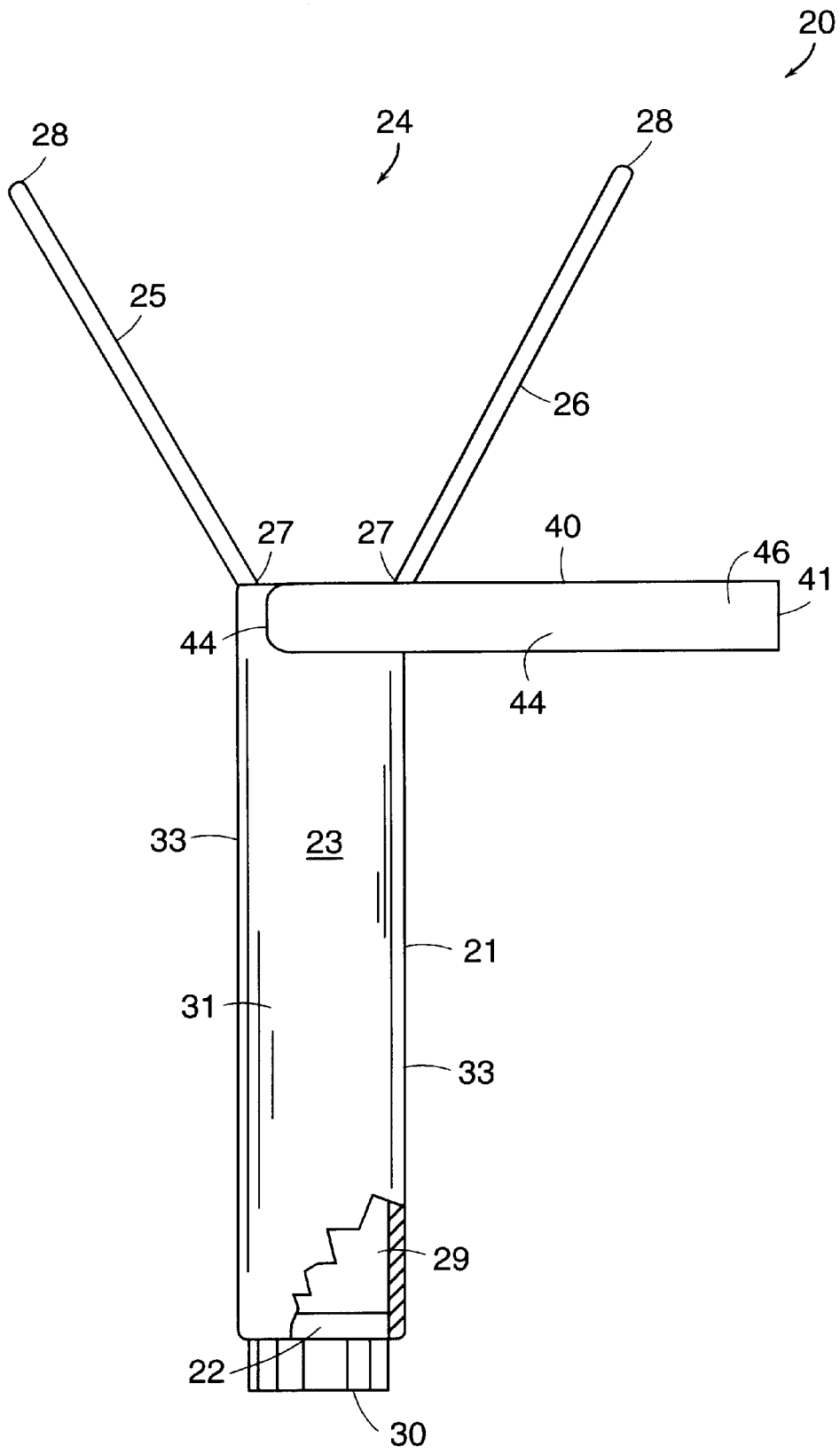
FIG. 2 is a front view of the invention apparatus.
Figure 3:
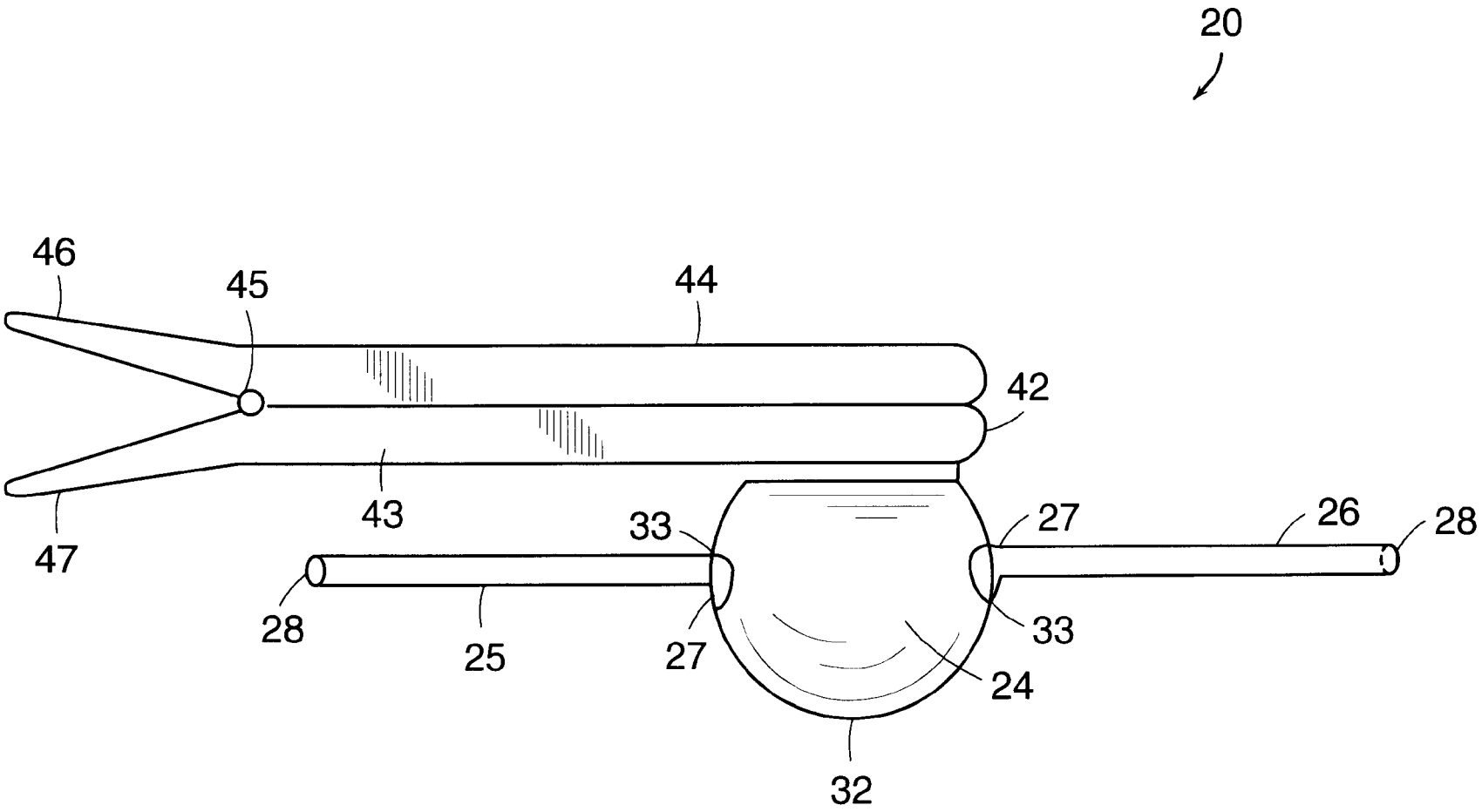
FIG. 3 is a top view of the invention apparatus.

Referring to the drawings in detail wherein like elements are indicated by like numerals, there is shown an embodiment of the invention incorporating a necktie knot forming apparatus 20 and method. The necktie 10 comprises an elongated strip of fabric which is normally worn by wrapping a portion 13 of the necktie 10 intermediate two free end sections 11, 12 thereof around the wearer's neck under the collar of his shirt, forming a knot 14 in the general shape of an inverted, truncated triangle in the portions of the free ends of the necktie 10 extending just past the wearer's collar, allowing the free end sections 11, 12 to extend downwardly therefrom in overlapped relationship. One free end section 11 is generally wider than the other free end section 12 and is normally positioned on top of the second free end section 12 when the necktie knot 14 is fully formed.

The necktie knot forming apparatus 20 comprises a cylindrical and generally vertical body 21 having an open bottom 22 from which cylindrical side walls 23 extend vertically upward, said body 21 being generally cylindrical in shape, the central longitudinal axis of said cylindrical body 21 being generally perpendicular to said bottom 22, said body 21 having a top 24 connected to said cylindrical side walls 23. Said top 24 has two projecting and divergent elongated, resilient elements 25, 26 protruding therefrom, each element 25, 26 being in mirror relation to the other 26, 25. Each element 25, 26 has an attached end 27 and a free end 28. The body 21 has a hollow bore 29 accessible through the open bottom 22. A plug 30 is removably inserted into the open bottom 22 in order to enclose the hollow bore 29. The hollow bore 29 may hold small dressing items such as cuff links, directions for making a necktie knot, and the like. In an alternate embodiment, the plug 30 may be replaced with a cap snap fitted or threadingly engaged to the bottom 22.

An elongated fastening element 40 is attached to the cylindrical body 21 adjacent the body top 24. The body side 31 to which the fastening element 40 is attached is termed the apparatus front and the opposite side 32 the apparatus rear. The body sides 33 connecting the front 31 and rear 32 are termed the apparatus sides 33. The divergent elements 25 lie in the same plane as the apparatus sides 33.

The fastening element 40 has a proximal end 41 and a distal end 42 defining the longitudinal axis of the fastening element 40. The fastening element longitudinal axis is generally horizontal and perpendicular to the central longitudinal axis of the cylindrical body 21 and is positioned in the same general plane as the apparatus front 31. The fastening element 40 has the form of a clasp which holds the necktie free end sections 11, 12 before and while the knot 14 is being formed. The fastening element 40 has two elongated, horizontal prongs 43, 44 extending distally from a spring element 45 located near to the fastener's proximal end 41. One prong 43 is positioned in parallel and horizontally behind the other prong 44. The spring element 45 has two opposite and divergent levers 46, 47 extending to and forming the fastening element proximal end 41. The spring element 45 keeps the prongs 43, 44 tensioned against each other. The tension on the fastener 40 is sufficient to retain the prongs 43, 44 against each other. Closing finger pressure on the levers 46, 47 will spread the prongs 43, 44 apart. The fastening element 40 is fixedly joined to the cylindrical body 21 by attachment of the rearward prong 43 distal end 42 to the cylindrical body 24.

Figure 4:
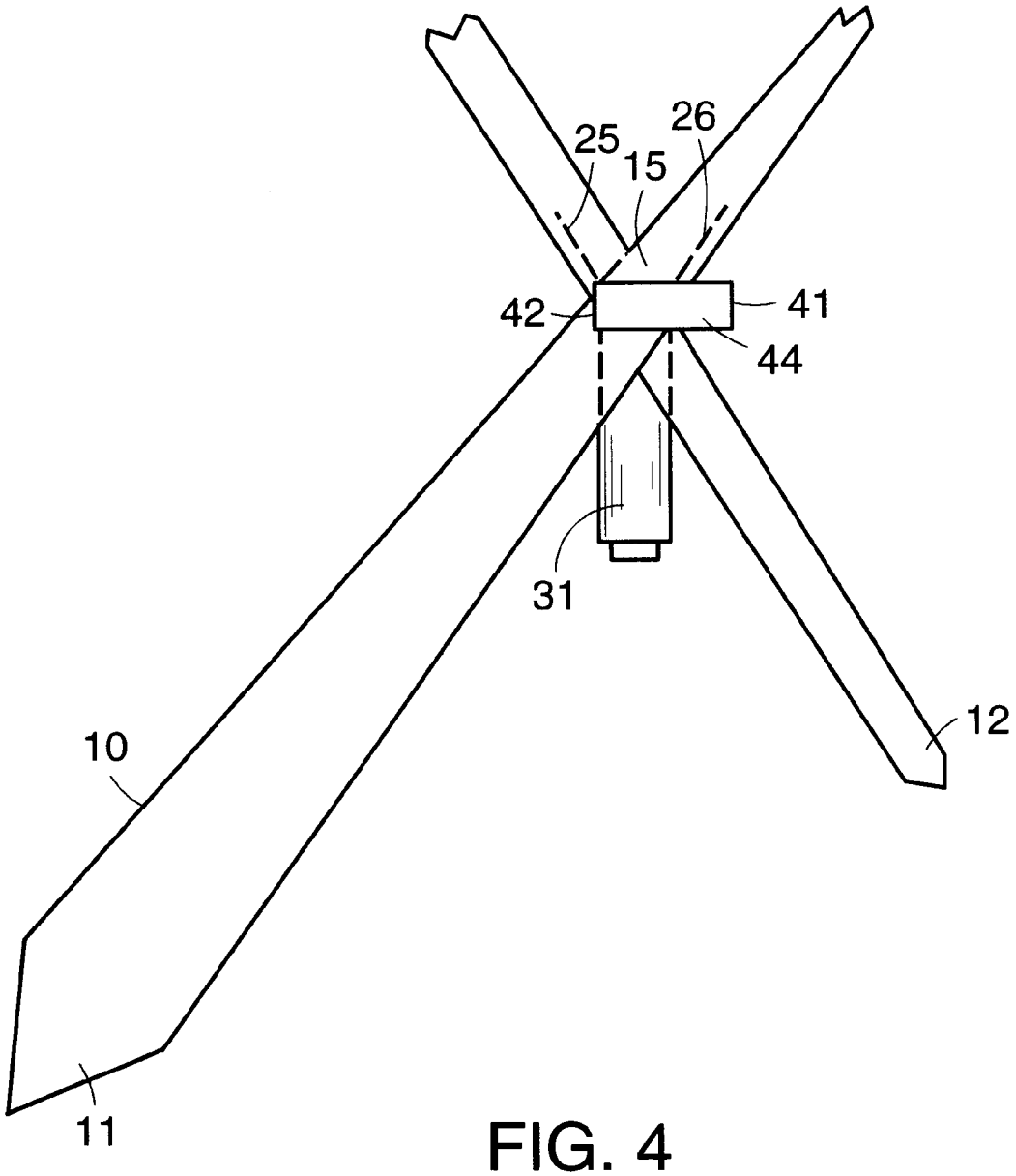
FIG. 4 is a schematic illustration of the invention illustrating the first step in the formation of a necktie knot.
Figure 5:
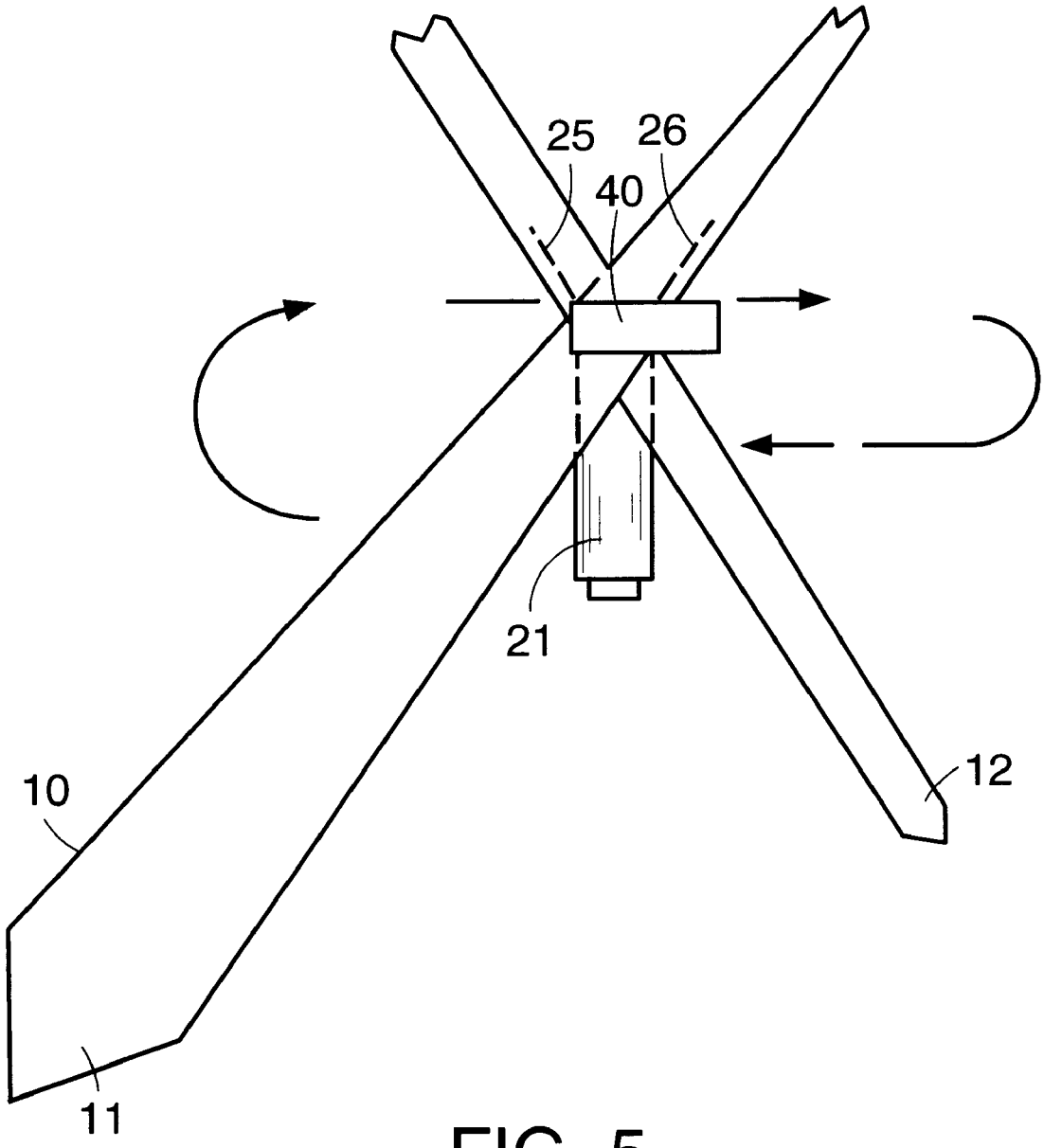
FIG. 5 is a view similar to FIG. 4 illustrating the second step in the formation of a necktie knot.
Figure 6:
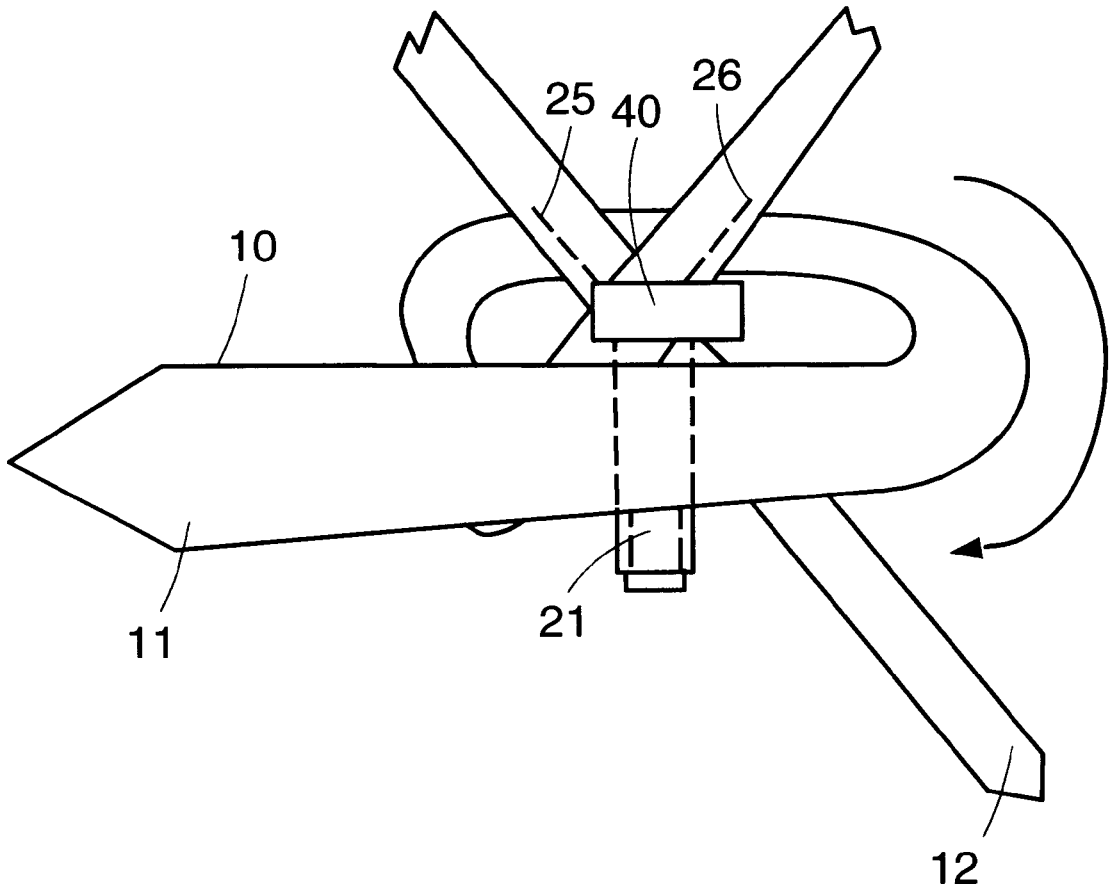
FIG. 6 is a view similar to FIG. 5 illustrating the third step in the formation of a necktie knot.
Figure 7:
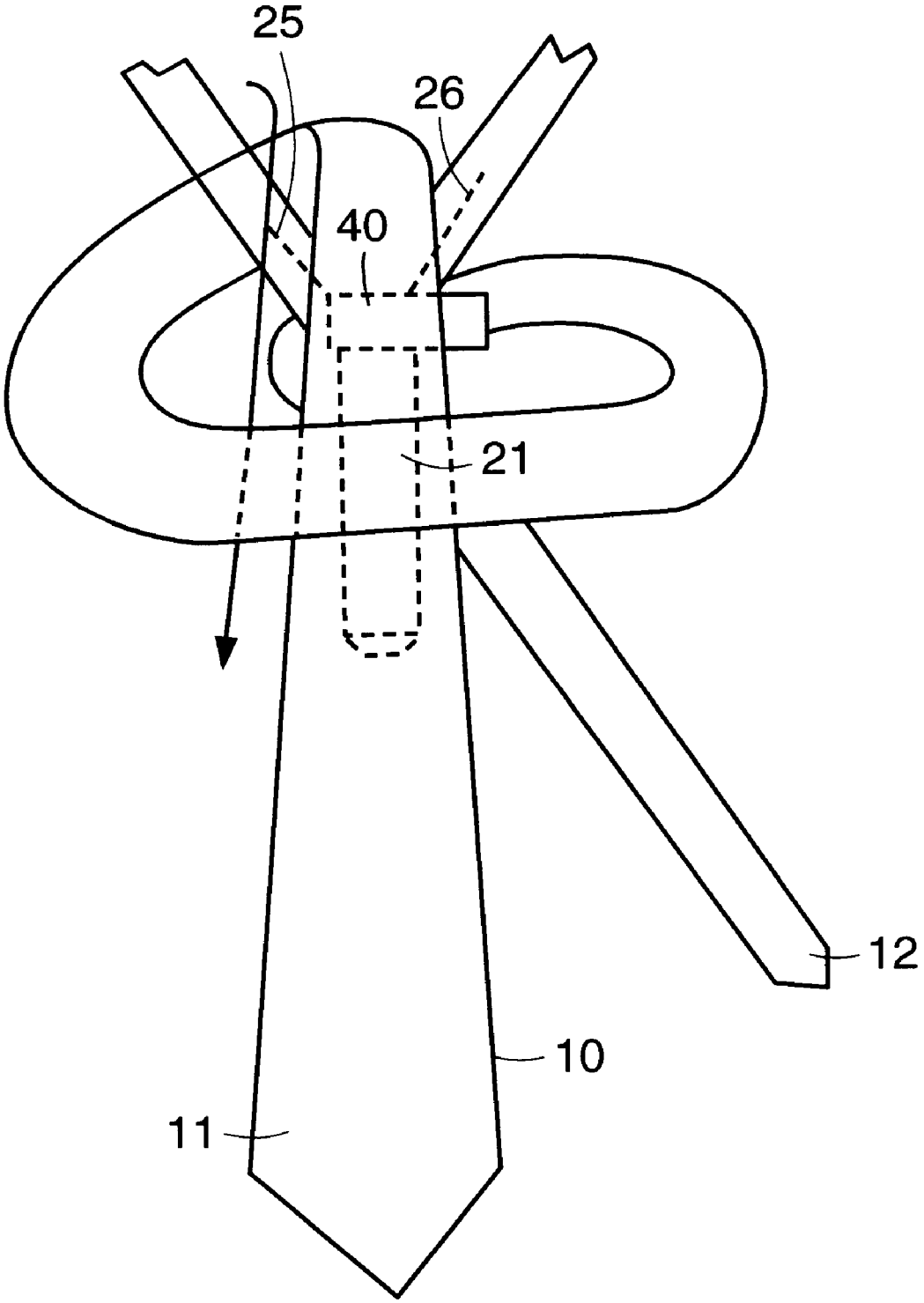
FIG. 7 is a view similar to FIG. 6 illustrating the fourth step in the formation of a necktie knot.
Figure 8:
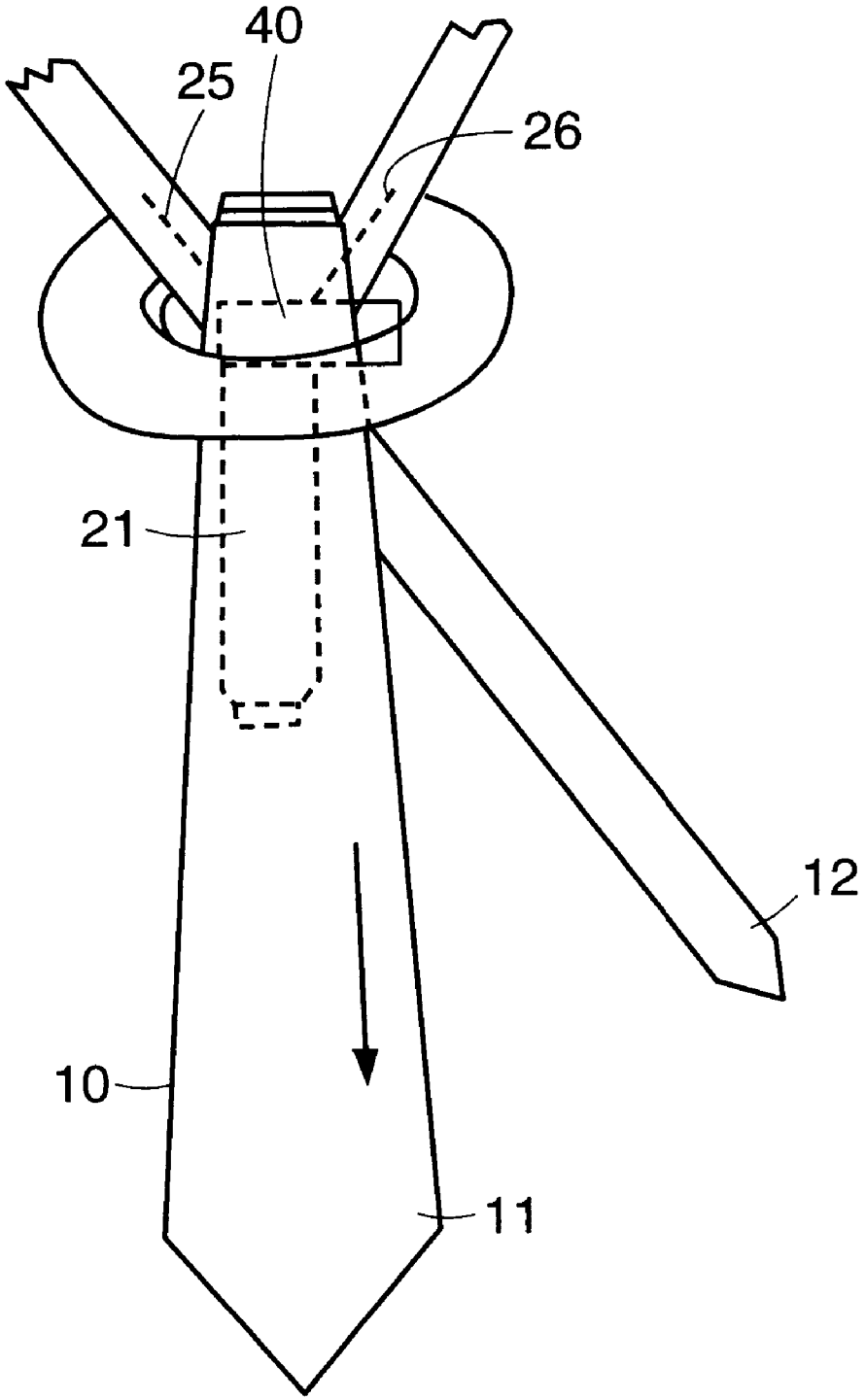
FIG. 8 is a view similar to FIG. 7 illustrating the fifth step in the formation of a necktie knot.
Figure 9:
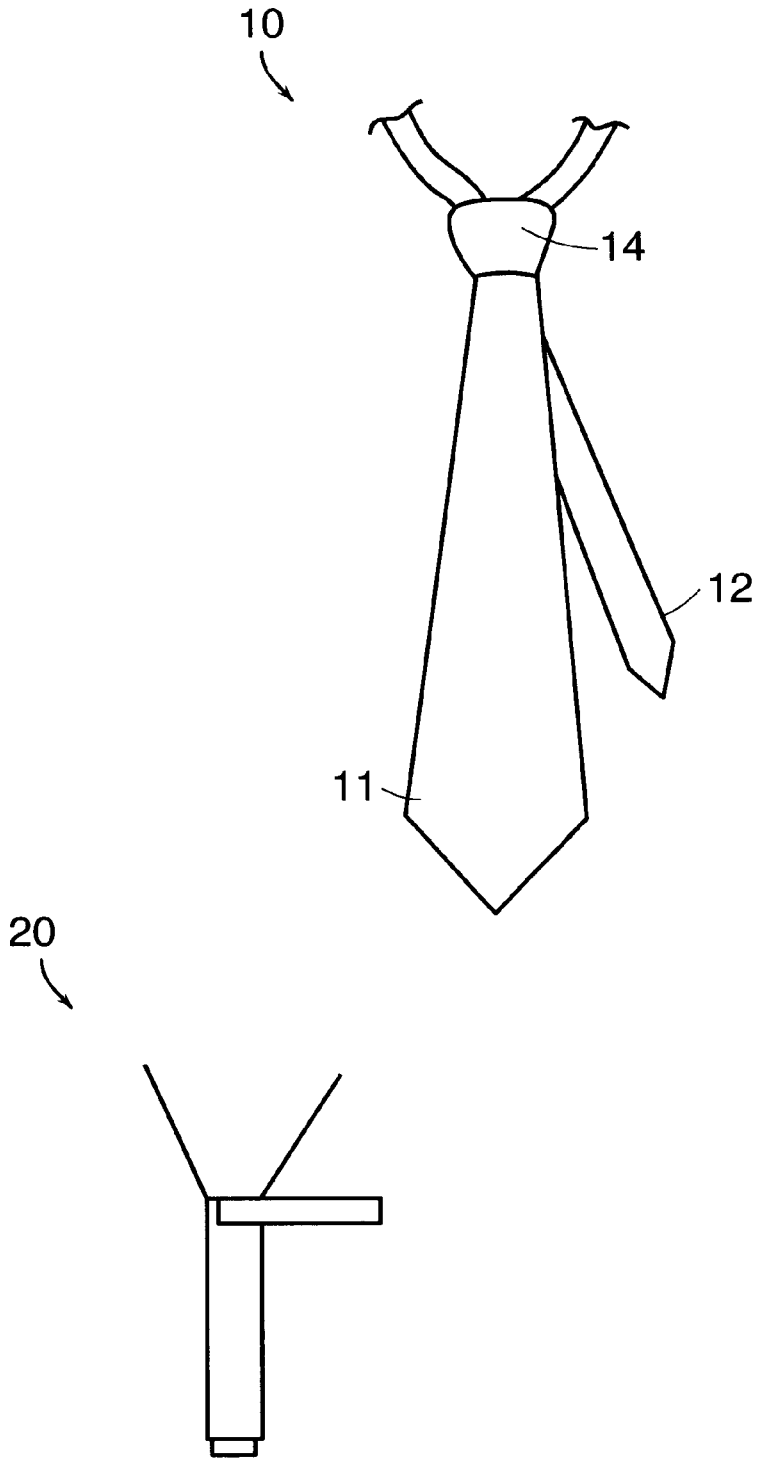
FIG. 9 is a view similar to FIG. 8 illustrating the necktie knot completely formed and the invention apparatus removed.

The operation of the invention will be described with particular reference to FIGS. 4–9. Referring to FIG. 4, the tie 10 is first placed around the collar of the wearer with the front or leading free end section 11 crossed over the back or trailing free end section 12. The invention apparatus 20 is then moved into place and the fastener 40 manipulated to temporarily grasp the tie at the point 15 where the tie overlaps itself. Attachment of the apparatus fastening element 40 is accomplished by grasping the levers 46, 47 until the prongs 43, 44 separate far enough to accommodate the tie material at the point 15 of overlap. The tension on the levers 46, 47 is then released to allow the prongs 43, 44 to clasp the tie and hold the tie in position for knotting. The fastener 40 is positioned so that the cylinder body 21 is generally vertical and the longitudinal axes of the apparatus divergent elements 25, 26 are positioned generally upward from the body 21 and parallel to the longitudinal axes of the tie end sections 11, 12. Referring now to FIGS. 5 and 6, the leading end section 11 of the tie 10 is passed behind the divergent elements 25, 26 and then laid across the apparatus front 31 proximate the fastening element 40. The divergent elements 25, 26 provide knotting shape and anchoring during these steps, while the fastening element 40 holds the tie 10 in position. Referring now to FIG. 7, the leading end section 11 is then passed over the apparatus top 24 between the divergent elements 25, 26 and down along the front 31 of the cylindrical body 21 beneath that portion of the leading end section laid across the apparatus front 31 proximate the fastening element 40. As may be seen now from FIG. 8, the knot 14 is loosely formed. The knot 14 is then tightened by pulling the leading end section 11 downwardly. Referring to FIG. 9, the fastening element 40 is disengaged by pressing the levers 46, 47 together, thereby opening the prongs 43, 44. The apparatus 20 is then slid downward away from the tie knot 14.

It is understood that the above-described embodiment is merely illustrative of the application. Other embodiments may be readily devised by those skilled in the art which will embody the principles of the invention and fall within the spirit and scope thereof. The apparatus and method of the present invention may be used for other types of tie knots, such as windsor and half-windsor knots.

I claim:

1. A knot forming apparatus for a necktie comprised of an elongated strip of fabric which is normally worn by wrapping a portion of the necktie intermediate two free end sections thereof around a wearer's neck under a collar of a wearer's shirt, forming a knot in the general shape of an inverted, truncated triangle in the portions of the free ends of the necktie extending just past the wearer's collar, allowing the free end sections to extend downwardly therefrom in overlapped relationship, one free end section being generally wider than the other free end section and being normally positioned on top of the other free end section when the necktie knot is fully formed, comprising:

a main, cylindrical, generally vertical body having two ends;

means connected to the body for holding a necktie in position while a knot in the necktie is being formed; and two projecting and divergent elongated, resilient elements protruding from one end of the cylindrical body, said elements providing wrap assist elements for knot formation.

2. An apparatus as recited in claim 1, wherein:

one said body end is an open bottom from which cylindrical side walls extend vertically upward, said body being generally cylindrical in shape, the central longitudinal axis of said cylindrical body being generally perpendicular to said bottom, said body having a top end connected to said cylindrical side walls.

3. An apparatus as recited in claim 2, wherein:

said two projecting and divergent elongated, resilient elements protrude from a top body end, each element being in mirror relation to the other element, each element having an attached end and a free end, each said attached end being connected to said top body end.

4. An apparatus as recited in claim 3, wherein:

said body has a hollow bore accessible through the open bottom end.

5. An apparatus as recited in claim 4, further comprising:

a plug removably inserted into the open bottom thereby enclosing said hollow bore.

6. An apparatus as recited in claim 5, wherein:

said means connected to the body for holding a necktie in position while a knot is being formed is an elongated fastening element attached to the cylindrical body side walls adjacent the body top, the body side wall to which the fastening element is attached being termed the apparatus front and the opposite side wall being termed the apparatus rear, the body side walls connecting the front wall and rear wall being termed the apparatus sides.

7. An apparatus as recited in claim 6, wherein:

said divergent elements lying in the same plane as the apparatus sides.

8. An apparatus as recited in claim 7, wherein:

said fastening element has a proximal end and a distal end, said ends defining a longitudinal axis of the fastening element, said fastening element longitudinal axis being generally horizontal and perpendicular to the central longitudinal axis of the cylindrical body and being positioned in the same general plane as the apparatus front.

9. An apparatus as recited in claim 8, wherein:

the fastening element has the form of a clasp which holds the necktie free end sections before and while the knot is being formed, said fastening element having two elongated, horizontal prongs extending distally from a spring element located near to the fastener's proximal end, one prong being positioned in parallel and horizontally behind the other prong, said spring element having two opposite and divergent levers extending to and forming the fastening element proximal end, wherein the spring element keeps the prongs tensioned against each other, the tension on the fastener being sufficient to retain the prongs against each other, wherein closing finger pressure on the levers will spread the prongs apart, wherein the fastening element is fixedly joined to the cylindrical body by attachment of the rearward prong distal end to the cylindrical body.

10. A method for forming a knot in a necktie, which necktie comprises an elongated strip of fabric which is normally worn by wrapping a portion of the necktie intermediate two free end sections thereof around a wearer's neck under a collar of a wearer's shirt, forming a knot in the general shape of an inverted, truncated triangle in the portions of the free ends of the necktie extending just past the wearer's collar, allowing the free end sections to extend downwardly therefrom in overlapped relationship, one free end section being generally wider than the other free end section and being normally positioned on top of the other free end section when the necktie knot is fully formed, said method comprising the steps of:

placing the necktie around the collar of the wearer with the wider free end section crossed over the narrower free end section;

moving a knot forming apparatus into place at the cross over point between the wider free end section and the narrower free end section, said apparatus including a main, cylindrical, generally vertical body having two ends, one said body end being an open bottom from which cylindrical side walls extend vertically upward, said body being generally cylindrical in shape, said body having a top end connected to said cylindrical side walls, an elongated fastening element attached to the cylindrical body side walls adjacent the body top, the body side wall to which the fastening element is attached being termed the apparatus front and the opposite side wall being termed the apparatus rear, the body side walls connecting the front wall and rear wall being termed the apparatus sides, and two projecting and divergent elongated, resilient elements protruding upwardly from the top end of the cylindrical body, said fastening element having a proximal end and a distal end, said ends defining a longitudinal axis of the fastening element, said fastening element longitudinal axis being generally horizontal and perpendicular to a central longitudinal axis of the cylindrical body and being positioned in the same general plane as the apparatus front, said fastening element having the form of a clasp, said fastening element having two elongated, horizontal prongs extending distally from a spring element located near to the fastener's proximal end, one prong being positioned in parallel and horizontally behind the other prong, said spring element having two opposite and divergent levers extending to and forming the fastening element proximal end, wherein the spring element keeps the prongs tensioned against each other, the tension on the fastener being sufficient to retain the prongs against each other, wherein closing finger pressure on the levers will spread the prongs apart, wherein the fastening element is fixedly joined to the cylindrical body by attachment of the rearward prong distal end to the cylindrical body;

manipulating the elongated fastening element to temporarily grasp the tie at the cross over point;

passing the wider free end section behind the divergent elements laying the wider free end section across the apparatus front proximate the fastening element;

passing the wider end section over the apparatus top between the divergent elements and down along the front of the cylindrical body beneath that portion of the wider end section laid across the apparatus front proximate the fastening element;

pulling said wider end section downwardly to tighten the resulting necktie knot;

disengaging the fastening element;

sliding the apparatus downward away from the tie knot.

11. The method as recited in claim 10, wherein:

manipulating the elongated fastening element is accomplished by grasping the levers until the prongs separate far enough to accommodate the tie material at the point of overlap, and releasing tension on the levers to allow the prongs to clasp the tie and hold the tie in position for knotting, wherein the fastening element is positioned so that the cylinder body is generally vertical and the longitudinal axes of the apparatus divergent elements are positioned generally upward from the body and parallel to the longitudinal axes of the tie end sections.

12. The method as recited in claim 11, wherein:

disengaging the fastening element is accomplished by pressing the levers together, thereby opening the prongs.

* * * * *